United States Patent [19]

Faiola et al.

[11] Patent Number: 4,840,275

[45] Date of Patent: Jun. 20, 1989

[54] GREETING CARD AND PACKAGE

[76] Inventors: Michael S. Faiola, 18424 Wachs Ter., Olney, Md. 20832; Richard J. Faiola, 335 N. Forty-Eighth St., Harrisburg, Pa. 17111

[21] Appl. No.: 10,982

[22] Filed: Feb. 5, 1987

[51] Int. Cl.[4] ..... B65D 85/50

[52] U.S. Cl. ..... 206/423; 206/462; 206/459; 206/575; 229/92.8

[58] Field of Search ..... 206/462, 463, 459, 575, 206/423; 229/92.8; 40/159

[56] References Cited

U.S. PATENT DOCUMENTS

| | | | |
|---|---|---|---|
| 1,011,697 | 12/1911 | Witkowski | 206/462 |
| 1,180,618 | 4/1916 | Stirn | 206/462 |
| 2,717,174 | 9/1955 | Casanovas | 229/92.8 |
| 2,997,226 | 8/1961 | Morris | 229/92.8 |
| 3,044,618 | 7/1962 | Surloff | 206/462 |
| 3,279,596 | 10/1966 | Prym et al. | 206/462 |
| 3,399,763 | 9/1968 | Stone | 206/462 |
| 3,491,471 | 1/1970 | Semple | 40/159 |
| 3,587,848 | 6/1971 | Froehlig | 206/462 |
| 4,466,534 | 8/1984 | Dunn | 206/462 |

FOREIGN PATENT DOCUMENTS

| | | | |
|---|---|---|---|
| 579278 | 8/1955 | Canada | 229/92.8 |
| 366415 | 5/1906 | France | 229/92.8 |

*Primary Examiner*—Joseph Man-Fu Moy
*Attorney, Agent, or Firm*—William H. Holt

[57] ABSTRACT

A greeting card including a removable, transparent receptacle for a gift, or token of affection such as a flower. The receptacle is detachably secured to the card for easy removal therefrom without damaging the card and without detracting from the appearance of the card.

13 Claims, 2 Drawing Sheets

FIG.1
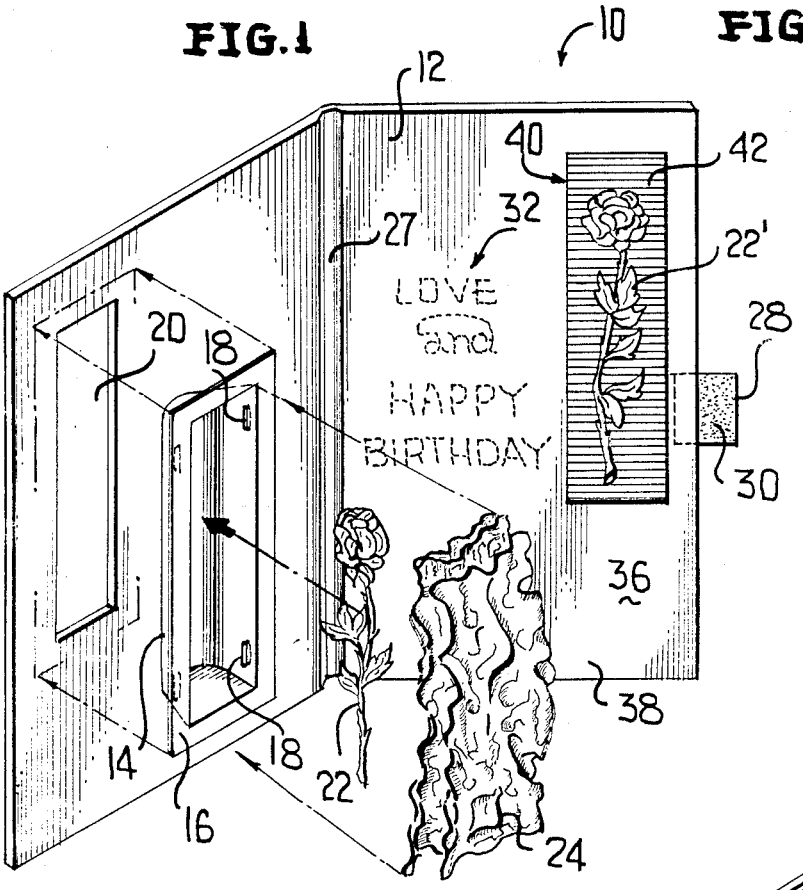
FIG.1a
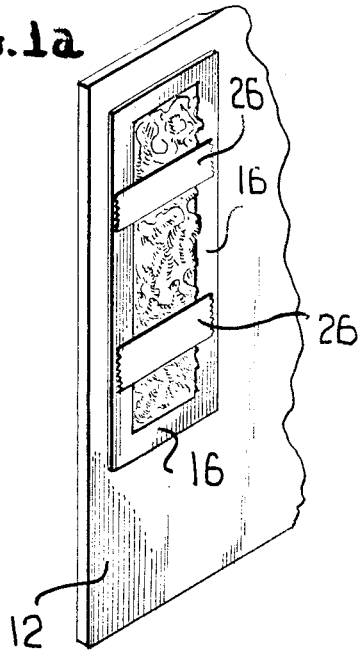
FIG.2
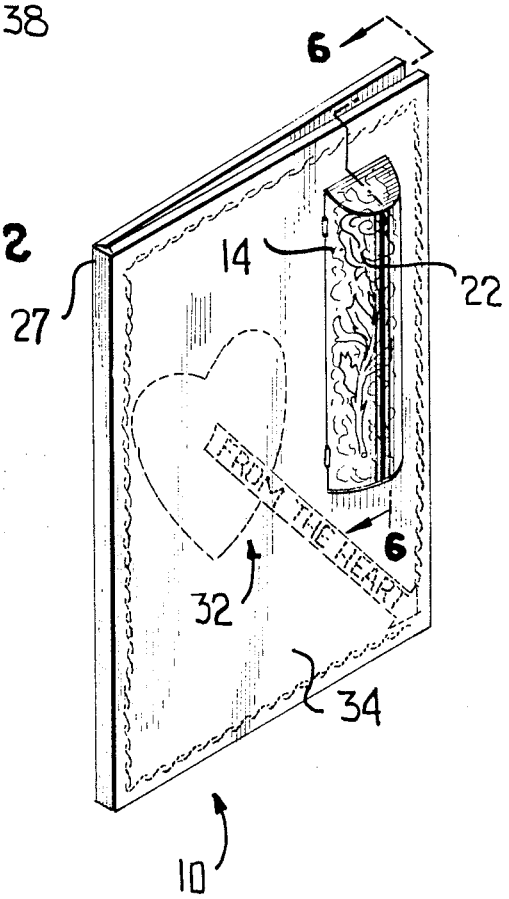
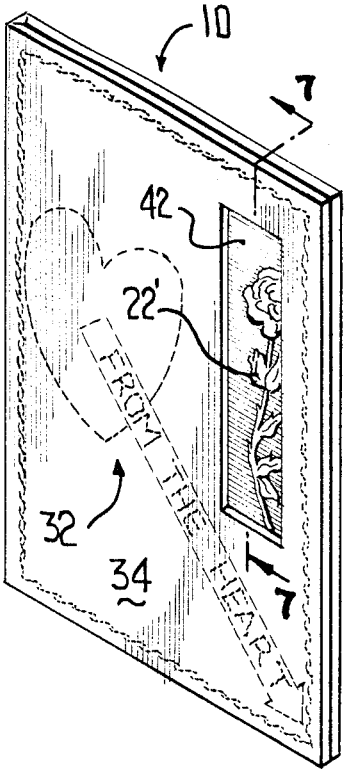
FIG.3

GREETING CARD AND PACKAGE

This invention relates to a greeting card, and more particularly to a greeting card which includes a display package or receptacle for a gift or other article to be presented on commemorative occasions such as birthdays, anniversaries, religious and secular holidays and special occasions of all types including, but not limited to, Mother's Day, Father's Day, Valentines Day, Graduation Day, Thanksgiving Day, Halloween and the like.

BACKGROUND OF THE PRIOR ART

Greeting cards are, of course, well known and have been produced for decades and used for many diverse occasions. For example, U.S. Pat. No. 4,584,213 discloses a greeting card having a live flower attached thereto. U. S. Pat. No. 2,314,721 disloses a package for containing a gift, such as a book, in combination with an appropriate greeting. U. S. Pat. Nos. 3,259,236 and 4,217,982 are examples of known devices for packaging flowers or foliage, while U. S. Pat. No. 2,796,985 discloses packaging for articles utilizing a transparent blister or bubble for displaying merchandise. U. S. Pat. No. Des. 135,551 discloses a greeting card in combination with a bookmark as a token gift.

SUMMARY OF THE INVENTION

The present invention relates to a package for an article such as a gift and, more importantly, to a greeting card as the supporting device to display the gift and to be used for gift giving occasions.

The particular design of greeting card and package is useful on multiple types of occasions and combines a suitable gift with an appropriate greeting that combines a sentiment and gift for the romance of the occasion.

An object of the invention is to provide a greeting card comprising a sheet of material and a receptacle for receiving and enclosing a gift, means for retaining the gift within the receptacle, means for detachably securing the receptacle to the sheet of material, and a greeting displayed on the greeting card.

Another object of the invention is to provide a greeting card as described above wherein an opening is formed through the sheet of material, the receptacle comprising a bubble formed of transparent material, the bubble being disposed in the opening and protruding from the sheet of material.

A further object of the invention is to provide such a greeting card wherein the bubble is open at one side thereof for receiving a gift therein, and the means for retaining the gift within the bubble is comprised of pressure sensitive tape.

A still further object of the invention is to provide such a greeting card wherein the sheet of material is folded upon itself for providing a front panel including a front surface and an inside surface and a back panel including an inside surface and a back surface, the opening being formed in the front panel.

Another object of the invention is to provide such a greeting card which includes decorative material on the inside surface of the back panel and disposed for being viewed through the opening.

An additional object of the invention is to provide decorative material which includes an embossed design formed in the back panel and wherein the decorative material includes a foil member secured to the inside surface of the back panel and includes the embossed design therein.

Another object of the invention is to provide a greeting card as described above wherein the embossed design comprises a pictorial representation of the gift, and wherein the gift comprises a flower.

A further object of the invention is to provide a greeting card as described above wherein the gift is a flower disposed within the receptacle, the means for retaining the gift within the receptacle being comprised of mat material for providing a background for the flower, and pressure sensitive adhesive means for securing the flow and mat material within the receptacle.

A still further object of the invention is to provide a greeting card as described above wherein the receptacle comprises a bubble formed of transparent material, an opening formed in the sheet of material, the bubble being disposed within the opening, the means for detachably securing the receptacle to the sheet of material being comprised of flange means on the bubble and nib means formed in the bubble, the flange means and nib means being disposed to secure the sheet of material therebetween.

Further objects of the invention include features such as making the sheet of material sufficiently rigid so that the card can stand upright without collapsing; the sheet includes a fold line along a central axis for connecting the front panel to the back panel; a locking tab for holding the front panel against the back panel for closing the greeting card and maintaining the gift within the receptacle; and the receptacle being comprised of an elongated transparent bubble and the gift comprising a long-stemmed rose.

BRIEF DESCRIPTION OF THE DRAWINGS

FIG. 1 is a perspective view of a greeting card in accordance with the present invention and illustrates the assembly of a receptacle, a long-stemmed rose and a background mat of tissue paper with the greeting card.

FIG. 1a is a fragmentary perspective view and shows the use of tape for holding the flower and paper within the receptacle.

FIG. 2 is a perspective view showing the front of the greeting card with the gift flower contained within the bubble-shaped, transparent receptacle.

FIG. 3 is a perspective view of the front of the greeting card after the receptacle and gift have been removed therefrom, and a design on the inside surface of the back panel shows through an opening in the front panel.

FIG. 5 is a fragmentary, sectional view taken on line 5—5 of FIG. 4, and illustrates the receptacle having a flange and a plurality of locking nibs for securing the receptacle to the sheet of material which is formed of paper or the like.

DETAILED DESCRIPTION OF THE INVENTION

Figure 7:
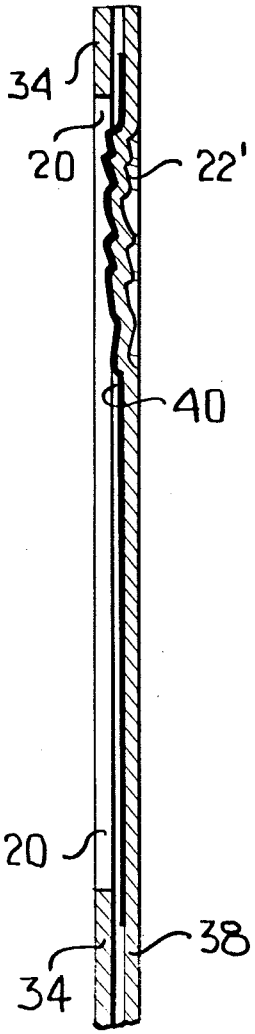
FIG. 7 is a fragmentary, sectional view taken along line 7—7 of FIG. 3 and illustrates a design which is embossed on the sheet of material which forms the card stock of the greeting card and a thin sheet of foil which is adhered to the inside surface of the back panel.
Figure 6:
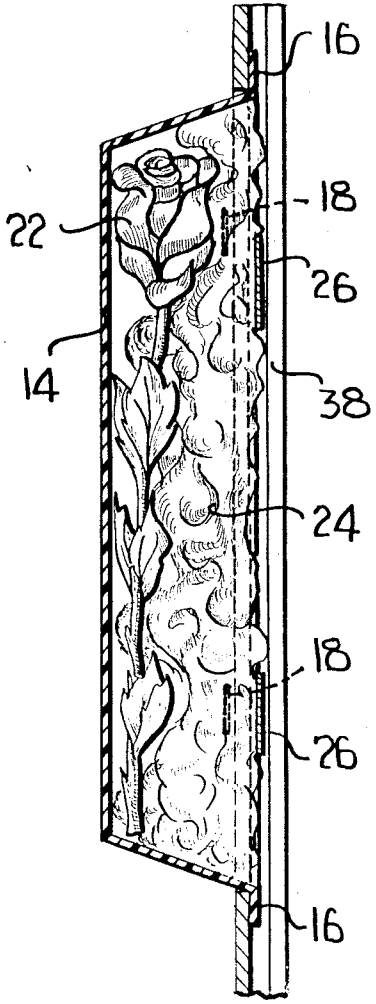
FIG. 6 is a fragmentary, sectional view taken along line 6—6 of FIG. 2 and illustrates the gift as being a rose, or other flower, contained within the bubble-like receptacle.

A greeting card, generally indicated by the numeral 10, is comprised of a sheet of material 12 and a receptacle 14. The sheet of material 12 may be formed of a single sheet construction or may be of a two-sheet construction. The single sheet construction would, preferably, be comprised of a single sheet of paper, or may be of other material, coated on one side to provide an ink-receptive or foil-receptive surface for graphics; or, alternatively, may be coated on both sides. If the two-sheet construction is desired, two sheets of paper or other material are pasted together under pressure with cold adhesive; the top sheet would be comprised of a sheet of paper coated on one side with the coating as the exposed surface, while the bottom sheet would be comprised of a sheet of paper coated on one side with the uncoated surface to be exposed. In either case, it is preferred that the thickness of the sheet of material 12 be approximately 0.035 inch to provide the greeting card 10 with sufficient rigidity to stand without support.

Figure 5:
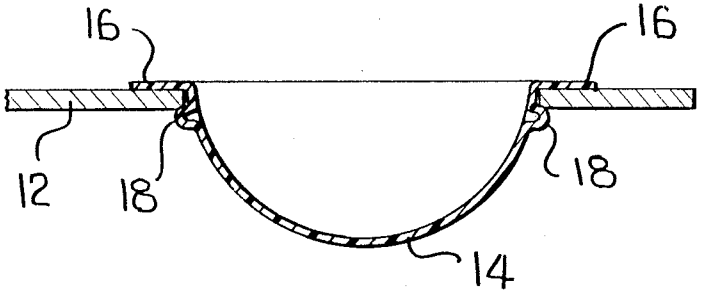

Receptacle 14 is molded from clear or tinted plastic and has an approximate thickness of 0.013 inch. It may be formed of different shapes depending upon the product or gift to be contained therein; in the presently preferred form, as shown, receptacle 14 comprises an elongated bubble which is provided about its periphery with a flange 16 and a plurality of locking nibs 18 which are formed in the bubble and protrude approximately $\frac{1}{8}$ inch at a location spaced approximately $\frac{1}{4}$ inch from flange 16 for providing a snap-fit with the sheet of material 12 and can be removed therefrom without causing visible damage to the greeting card 10. Flange 16 and locking nibs 18 cooperate to detachably secure receptacle 14 to the sheet material 12 in a manner best shown in FIG. 5.

As is shown in FIG. 1, an opening 20 is formed in the sheet of material 12, preferably by die cutting, in a shape and size to receive receptacle 14 therein. A long-stemmed rose 22, or any other gift or article, is positioned and enclosed within receptacle 14 and provided with a mat of material 24 which may be, for example, some sheets of crumpled tissue paper, or the like, for cushioning rose 22 and providing a pleasing background therefor. As is shown in FIG. 1*a*, the rose 22, or other gift, may be retained in receptacle 14 by strips of pressure sensitive adhesive tape 26 which adheres to flange 16 and can be readily removed therefrom without damaging the sheet of material 12. It is to be understood, of course, that other suitable means may be used to retain the rose 22, or other gift, within receptacle 14, for example, a paper or plastic backing could be adhesively secured to flange 16, or a piece of plastic with in-turned edges could be latched over and to flange 16. Further, it is contemplated that some gifts may be simply retained by closing the card 10 by folding it about a centrally located fold line 27 and locking it closed by using a tab 28 which is coated with a layer of adhesive 30, preferably of a type which may be peeled from material 12 without causing visible damage thereto.

The greeting card 10 will embody a message, generally indicated by the numeral 32, which may include words and/or sentimental symbols, on a front surface 32 of a front panel 34, and on an inside surface 36 of a back panel 38. It will be understood that the recipient of the card 10 and gift 22 will likely remove the gift from the card 10 and can also easily detach the receptacle 14, as can be observed by comparing FIG. 2, with receptacle 14 attached, and FIG. 3 wherein the receptacle 14 and rose 22 have been removed. It is, therefore, desirable to provide decorative material, generally indicated by the numeral 40, on the inside surface 36, of back panel 38 in a location aligned with opening 20. This feature is considered to be an important feature of the invention.

Figure 4:
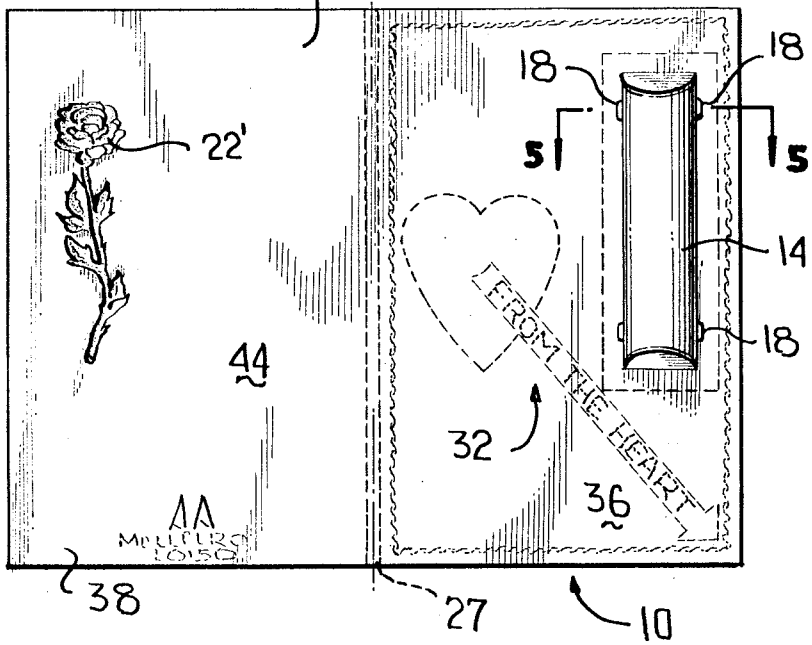
FIG. 4 is an elevational view of the greeting card and shows the front and rear surfaces of the greeting card with the rear surface having a debossed design formed therein.

Decorative material 40 comprises a thin foil sheet 42 which is impressed or otherwise secured to surface 36 and may have a design printed or formed thereon. In a presently preferred form of the invention, a design of a rose 22' is embossed into the sheet material 12 and into the foil sheet 42. As is best shown in FIGS. 4 and 7, the design of rose 22' is debossed into a back surface 44 of back panel 38. It is contemplated that other and different designs will be utilized in lieu of decorative material 40 depending upon the type and nature of the gift contained in receptacle 14.

While a presently preferred form of the invention has been shown in the drawings and described above, it is to be understood that various modifications and changes can be made without departing from the spirit and scope of the invention as defined in the appended claims. For example, the gift may be any type of live or artificial flower, toy, candy, trinket, or even articles of clothing such as a lady's scarf, a man's tie, handkerchief and the like. In any event, the decorative material 40 provides a complementary design. Further, the size, shape and location of receptacle 14 may be varied from the presently preferred dimensions wherein the sheet of material 12 is 25 inches wide and 19 inches high, with the transparent bubble or receptacle 14 being 10.5 inches long, 2.5 inches wide and the flange 14 extends 0.5 inch.

We claim:

1. A greeting card comprising a sheet of material and a receptacle for receiving and enclosing a gift, means for retaining said gift within said receptacle, means for detachably securing said receptacle to said sheet of material so that said receptacle may be easily detached from said sheet of material without causing visible damage thereto; said receptacle comprising a bubble, an opening formed through said sheet of material, and said bubble being disposed in said opening and protruding from said sheet of material, said receptacle comprising a bubble formed of transparent material, said means for detachably securing said receptacle to said sheet of material being comprised of flange means on said bubble and nib means formed in said bubble, said flange means and said nib means being disposed to secure said sheet of material therebetween, said sheet of material including a front panel and a back panel, said opening being located in said front panel for exposing a portion of said back panel, said portion of said back panel being provided with decorative material which is aligned with said opening and visible through said opening whenever said receptacle is detached from said sheet of material.

2. A greeting card as defined in claim 1 wherein said decorative material is comprised of an embossed design.

3. A greeting card as defined in claim 1 wherein said decorative material comprises a foil sheet affixed to said back panel, and a design being provided on said foil sheet.

4. A greeting card as defined in claim 1 wherein said sheet of material is sufficiently rigid for standing substantially upright without collapsing.

5. A greeting card as defined in claim 4 including a fold line formed in said sheet of material along a central axis thereof and hingedly connecting said front panel to said back panel.

6. A greeting card as defined in claim 5 including a locking tab for holding said front panel against said back panel for closing said greeting card and maintaining said gift within said receptacle.

7. A greeting card comprising a sheet of material and a receptacle for receiving and enclosing a gift, means for retaining said gift within said receptacle, means for detachably securing said receptacle to said sheet of material so that said receptacle may be easily detached from said sheet of material without causing visible damage thereto; said receptacle comprising a bubble, an opening formed through said sheet of material, and said bubble being disposed in said opening and protruding from said sheet of material, said sheet of material being folded upon itself for providing a front panel including a front surface and an inside surface and a back panel including an inside surface and a back surface, said opening being formed in said front panel, and decorative material on the inside surface of said back panel and disposed for being viewed through said opening when said card is folded to a closed position.

8. A greeting card as defined in claim 7 wherein said decorative material includes an embossed design formed in said back panel.

9. A greeting card as defined in claim 8 wherein said decorative material includes a foil member secured to said inside surface of said back panel and said foil member includes said embossed design.

10. A greeting card as defined in claim 9 wherein said embossed design comprises a pictorial representation of said gift.

11. A greeting card as defined in claim 10 wherein said gift is a flower, and said embossed design is shaped in the form of a similar flower.

12. A greeting card comprising a sheet of material and a receptacle for receiving and enclosing a gift, means for retaining said gift within said receptacle, means for detachably securing said receptacle to said sheet of material so that said receptacle may be easily detached from said sheet of material without causing visible damage thereto; said receptacle comprising a bubble, an opening formed through said sheet of material, and said bubble being disposed in said opening and protruding from said sheet of material, said gift being a flower disposed within said receptacle, said means for retaining said gift within said receptacle being comprised of mat material for providing a background for said flower and pressure sensitive adhesive means for securing said flower and mat material within said receptacle.

13. A greeting card as defined in claim 34 wherein said receptacle comprises a bubble formed of transparent material, said means for detachably securing said receptacle to said sheet of material being comprised of flange means on said bubble and nib means formed in said bubble, said flange means and said nib means being disposed to secure said sheet of material for providing a snap-fit therebetween.

* * * * *